US006539747B2

(12) United States Patent
Minta et al.

(10) Patent No.: US 6,539,747 B2
(45) Date of Patent: Apr. 1, 2003

(54) PROCESS OF MANUFACTURING PRESSURIZED LIQUID NATURAL GAS CONTAINING HEAVY HYDROCARBONS

(75) Inventors: Moses Minta, Sugar Land, TX (US); Ronald R. Bowen, Magnolia, TX (US); James R. Rigby, Kingwood, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/050,833

(22) Filed: Jan. 15, 2002

(65) Prior Publication Data

US 2002/0088249 A1 Jul. 11, 2002

Related U.S. Application Data

(60) Provisional application No. 60/265,658, filed on Jan. 31, 2001.

(51) Int. Cl.[7] ..... F25J 3/00

(52) U.S. Cl. ..... 62/620; 62/623

(58) Field of Search ..... 62/611, 612, 613, 62/622, 623, 620

(56) References Cited

U.S. PATENT DOCUMENTS

| | | | | |
|---|---|---|---|---|
| 2,090,163 | A | 8/1937 | Twomey | 62/175 |
| 2,410,583 | A | 11/1946 | Hutchinson | 260/676 |
| 2,528,028 | A | 10/1950 | Barry | 260/676 |
| 2,535,148 | A | 12/1950 | Martin et al. | 48/190 |
| 2,900,797 | A | 8/1959 | Kurata et al. | 62/12 |
| 2,984,080 | A | 5/1961 | Sliepcevich | 62/48 |
| 3,074,245 | A | 1/1963 | Becker | 62/12 |
| 3,132,016 | A | 5/1964 | Kurata | 62/15 |
| 3,232,725 | A | 2/1966 | Secord et al. | 48/190 |
| 3,236,057 | A | 2/1966 | Hashemi-Tafreshi | 62/12 |
| 3,298,805 | A | 1/1967 | Secord et al. | 48/190 |
| 3,331,214 | A | 7/1967 | Proctor et al. | 62/20 |
| 3,360,943 | A | 1/1968 | Schoenfeld et al. | 62/10 |
| 3,376,709 | A | 4/1968 | Dickey et al. | 62/12 |

(List continued on next page.)

FOREIGN PATENT DOCUMENTS

| | | | |
|---|---|---|---|
| WO | WO 90/00589 | * | 1/1990 |
| WO | WO 98/01335 | | 1/1998 |
| WO | WO 90/00589 | | 1/1999 |
| WO | WO 99/60316 | | 11/1999 |

OTHER PUBLICATIONS

The Ocean Phoenix Pressure–LNG System, Faridany et al, pp267–280.*

R. H. Buchanan and A. V. Drew, "Techno–Economic Case for Offshore LNG", 21st Offshore Technology Conference, Houston, Texas, pp. 373–384, May 1–4, 1989.

Roger J. Broeker, "CNG and MLG—New Natural Gas Transportation Processes", American Gas Journal, pp. 45–50, Jul. 1969.

E. K. Faridany, H. C. Secord, J. V. O'Brien, J. F. Pritchard, and M. Banister, "The Ocean Phoenix Pressure—LNG System", pp. 267–280.

*Primary Examiner*—William C. Doerrler
(74) *Attorney, Agent, or Firm*—Gary D. Lawson

(57) ABSTRACT

The invention relates to a process of manufacturing a pressurized multi-component liquid from a pressurized, multi-component stream, such as natural gas, which contains $C_{5+}$ components and at least one component of $C_1$, $C_2$, $C_3$, or $C_4$. The process selectively removes from the multi-component stream one or more of the $C_{5+}$ components that would be expected to crystallize at the selected temperature and pressure of the pressurized multi-component liquid product and leaves in the multi-component stream at least one $C_{5+}$ component. The multi-component stream is then liquefied to produce a pressurized liquid substantially free of crystallized $C_{5+}$ components. The removal of the $C_{5+}$ components can be by selective fractionation or crystallization.

24 Claims, 3 Drawing Sheets

U.S. PATENT DOCUMENTS

| | | | | | |
|---|---|---|---|---|---|
| 3,663,644 | A | | 5/1972 | Harvey | 260/683 |
| 3,724,225 | A | | 4/1973 | Mancini et al. | 62/12 |
| 4,001,116 | A | | 1/1977 | Selcukoglu | 210/83 |
| 4,010,622 | A | | 3/1977 | Etter | 62/48 |
| 4,246,015 | A | | 1/1981 | Styring, Jr. | 62/12 |
| 4,511,382 | A | | 4/1985 | Valencia et al. | 62/20 |
| 4,828,591 | A | | 5/1989 | Yan | 62/9 |
| 5,025,860 | A | | 6/1991 | Mandrin | 166/267 |
| 5,199,266 | A | | 4/1993 | Johansen | 62/8 |
| 5,325,673 | A | * | 7/1994 | Durr et al. | 62/634 |
| 5,772,733 | A | | 6/1998 | Lokhandwala et al. | 95/39 |
| 5,941,096 | A | | 8/1999 | Gudmundsson | 62/633 |
| 5,950,453 | A | | 9/1999 | Bowen et al. | 62/612 |
| 5,956,971 | A | | 9/1999 | Cole et al. | 62/623 |
| 5,960,644 | A | | 10/1999 | Nagelvoort et al. | 62/622 |
| 6,003,603 | A | | 12/1999 | Breivik et al. | 166/357 |
| 6,016,665 | A | | 1/2000 | Cole et al. | 62/612 |
| 6,016,667 | A | | 1/2000 | Doerler et al. | 62/625 |
| 6,023,942 | A | | 2/2000 | Thomas et al. | 62/613 |
| 6,062,041 | A | | 5/2000 | Kikkawa et al. | 62/613 |
| 6,199,403 | B1 | | 3/2001 | Cole et al. | 62/613 |
| 6,333,445 | B1 | | 12/2001 | O'Brien | 585/809 |

* cited by examiner

PROCESS OF MANUFACTURING PRESSURIZED LIQUID NATURAL GAS CONTAINING HEAVY HYDROCARBONS

RELATED U.S. APPLICATION DATA

This application claims the benefit of U.S. Provisional Application No. 60/265,658, filed Jan. 31, 2001.

FIELD OF THE INVENTION

The invention relates to a process for making pressurized multi-component liquid, and more particularly to a process for making pressurized liquid natural gas comprising hydrocarbon components heavier than $C_5$.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

The source gas for making LNG is typically obtained from a crude oil well (associated gas) or from a gas well (non-associated gas). Associated gas occurs either as free gas or as gas in solution in crude oil. Although the composition of natural gas varies widely from field to field, the typical gas contains methane ($C_1$) as a major component. The natural gas stream may also typically contain ethane ($C_2$), higher hydrocarbons ($C_{3+}$), and minor amounts of contaminants such as carbon dioxide ($CO_2$), hydrogen sulfide, nitrogen, dirt, iron sulfide, wax, and crude oil. The solubilities of the contaminants vary with temperature, pressure, and composition. At cryogenic temperatures, $CO_2$, water, other contaminants, and certain heavy molecular weight hydrocarbons can form solids, which can potentially plug flow passages in cryogenic equipment. These potential difficulties can be avoided by removing such contaminants and heavy hydrocarbons.

Commonly used processes for transporting remote gas separate the feed natural gas into its components and then liquefy only certain of these components by cooling them under pressure to produce liquefied natural gas ("LNG") and natural gas liquid ("NGL"). Both processes liquefy only a portion of a natural gas feed stream and many valuable remaining components of the gas have to be handled separately at significant expense or have to be otherwise disposed of at the remote area.

In a typical LNG process, substantially all the hydrocarbon components in the natural gas that are heavier than propane (some butane may remain), all "condensates" (for example, pentanes and heavier molecular weight hydrocarbons) in the gas, and all of the solid-forming components (such as $CO_2$ and $H_2S$) in the gas are removed before the remaining components (e.g. methane, ethane, and propane) are cooled to cryogenic temperature of about −160° C. The equipment and compressor horsepower required to achieve these temperatures are considerable, thereby making any LNG system expensive to build and operate at the producing or remote site.

In a NGL process, propane and heavier hydrocarbons are extracted from the natural gas feed stream and are cooled to a low temperature (above about −70° C.) while maintaining the cooled components at a pressure above about 100 kPa in storage. One example of a NGL process is disclosed in U.S. Pat. No. 5,325,673 in which a natural gas stream is pretreated in a scrub column in order to remove freezable (crystallizable) $C_{5+}$ components. Since NGL is maintained above −40° C. while conventional LNG is stored at temperatures of about −160° C., the storage facilities used for transporting NGL are substantially different, thereby requiring separate storage facilities for LNG and NGL which can add to overall transportation cost.

Another process for transporting natural gas proposes saturating the natural gas with a liquid organic additive whereby the gas-additive mixture liquefies at a higher temperature than that of the gas alone. For example, in U.S. Pat. No. 4,010,622 (Etter) a natural gas additive is selected from hydrocarbons, alcohols, or esters having a chain length of $C_5$ to $C_{20}$ and which is liquid at ambient conditions. While the additive-containing natural gas mixture does liquefy at higher temperatures, thereby decreasing the refrigeration costs involved, the process still requires removal of the heavier natural gas components that would be valuable if transported.

It has also been proposed to transport natural gas at temperatures above −112° C. (−170° F.) and at pressures sufficient for the liquid to be at or below its bubble point temperature. This pressurized liquid natural gas is referred to as "PLNG" to distinguish it from LNG, which is transported at near atmospheric pressure and at a temperature of about −162° C. (−260° F.). Exemplary processes for making PLNG are disclosed in U.S. Pat. No. 5,950,453 (R. R. Bowen et al.); U.S. Pat. No. 5,956,971 (E. T. Cole et al.); U.S. Pat. No. 6,016,665 (E. T. Cole et al.); and U.S. Pat. No. 6,023,942 (E. R. Thomas et al.). Because PLNG typically contains a mixture of low molecular weight hydrocarbons and other substances, the exact bubble point temperature of PLNG is a function of its composition. For most natural gas compositions, the bubble point pressure of the natural gas at temperatures above −112° C. will be above about 1,380 kPa (200 psia). One of the advantages of producing and shipping PLNG at a warmer temperature is that PLNG can contain considerably more $C_{5+}$ components than can be tolerated in most LNG applications.

Depending upon market prices for ethane, propane, butanes, and the heavier hydrocarbons (collectively referred to herein as "NGL products"), it may be economically desirable to transport the NGL products with the PLNG and to sell them as separate products. International patent application published in 1990 under the Patent Cooperation Treaty as WO90/00589 (Brundige) disclosed a process of transporting pressurized liquid heavy gas containing butane and heavier components, including "condensibles" that are deliberately and intentionally left in the natural gas. In the Brundige process, basically the entire natural gas composition, regardless of its origin or original composition was liquefied without removal of various gas components. This was accomplished by adding to the natural gas an organic conditioner, preferably $C_2$ to $C_5$ hydrocarbons to change the composition of the natural gas and thereby form an altered gas that would be in a liquid state at a selected storage temperature and pressure. Brundige allows the liquefied product to be transported in a single vessel under pressurized conditions at a higher temperature than conventional transportation of LNG. One drawback to the Brundige process is that it does not address handling of heavy hydrocarbons in the natural gas stream that may freeze out at desired temperature and pressure conditions for storage and transportation of the liquefied gas.

In view of the above, it can be readily seen that a continuing need exists for an improved process for making PLNG that retains as much of the entire composition of a natural gas stream as possible, regardless of its origin or original composition, and that minimizes the potential crystallizing of hydrocarbon components at a selected storage temperature and pressure.

SUMMARY

The invention relates to a process of manufacturing a pressurized multi-component liquid from a pressurized, multi-component stream, such as natural gas, comprising $C_{5+}$ components and at least one component of $C_1$, $C_2$, $C_3$, or $C_4$. The process removes from the multi-component stream one or more of the $C_{5+}$ components and leaves in the multi-component stream at least one $C_{5+}$ component. The multi-component stream is then liquefied to produce a pressurized liquid substantially free of crystallizable $C_{5+}$ components at the temperature and pressure conditions of liquid product to be produced from the multi-component stream. In one embodiment, the removal of the one or more $C_{5+}$ components from the multi-component stream is carried out using a conventional fractionation system that produces a stream lean in the one or more $C_{5+}$ components and enriched in at least one other $C_{5+}$ component, which is then liquefied. In another embodiment, one or more of the $C_{5+}$ components contained in the multi-component gas stream is removed by crystallizing the one or more $C_{5+}$ components, leaving at least one $C_{5+}$ component substantially un-crystallized. The crystallized components are separated from the un-crystallized components and the un-crystallized components are liquefied.

BRIEF DESCRIPTION OF THE DRAWINGS

The invention and its advantages will be better understood by referring to the drawings in which like numerals identify like parts and function and in which.

Figure 1:
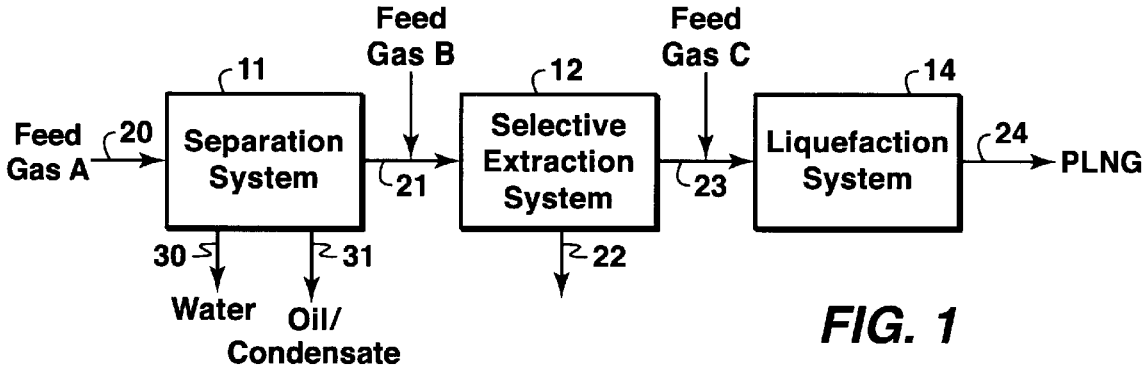
FIG. 1 is a diagrammatic representation of a basic process of the invention.

The drawings illustrate specific embodiments of practicing the process of this invention. The drawings are not intended to exclude from the scope of the invention other embodiments that are the result of normal and expected modifications of these specific embodiments.

DETAILED DESCRIPTION

The process of this invention selectively removes potentially freezable components from a natural gas stream prior to liquefaction of the gas stream in order to facilitate storage and transportation of the gas. In contrast to prior art techniques for removing essentially all $C_{5+}$ components prior to liquefaction, the invention selectively removes only the $C_{5+}$ components that could potentially freeze out at the desired storage and transportation conditions of the liquefied gas. At the temperature and pressure conditions for storing and transporting pressurized liquid natural gas (PLNG), a natural gas stream containing $C_{5+}$ component would typically contain some components that will not freeze out at the desired storage and transportation conditions.

In this description, PLNG is assumed to have a temperature above −112° C. (−170° F.) and a pressure sufficient for the liquid to be at or below its bubble point temperature. The term "bubble point" means the temperature and pressure at which a liquid begins to convert to gas. For example, if a certain volume of PLNG is held at constant pressure, but its temperature is increased, the temperature at which bubbles of gas begin to form in the PLNG is the bubble point temperature. Similarly, if a certain volume of PLNG is held at constant temperature but the pressure is reduced, the pressure at which gas begins to form defines the bubble point pressure at that temperature. At the bubble point, the liquefied gas is saturated liquid. For most natural gas compositions, the bubble point pressure of the natural gas at temperatures above −112° C. will be above about 1,380 kPa (200 psia). The bubble point pressure depends on the composition of the liquid. For a given temperature, the higher the concentration of $C_{2+}$ hydrocarbons in the liquid, the lower the bubble point pressure.

The present invention provides a technique for removing only the unwanted components from the gas stream prior to complete liquefaction at PLNG temperature and pressure conditions. The higher solubility of the heavy hydrocarbons and $CO_2$ in PLNG reduces or eliminates feed gas processing requirements for most natural gas projects.

Before proceeding further with the detailed description, basic principles of gas solubility are provided to aid the reader in understanding the invention. Table 1 shows pure-component crystallizing point temperatures of components typically found in natural gas. If for example, a PLNG product has a bubble point of about −95° C., the data in Table 1 would suggest to one skilled in the art that saturated hydrocarbon components having 7 or fewer carbon atoms ($C_{7-}$) would not be expected to freeze out in the PLNG, except for a few components, such as cyclo-hexane, cyclo-heptane and benzene, which have relatively high crystallizing points, and would likely freeze out. Referring to the alkane components of Table 1, those components above the horizontal line between $iC_8$ (iso-octane) and $nC_8$ (normal octane) would not be expected to freeze and those components below the line would be expected to freeze out at −95° C. However, as those skilled in the art would recognize, cyclo-hexane, cyclo-heptane and benzene in the presence of lower molecular weight hydrocarbons would have depressed crystallization points from those shown Table 1. For similar reasons, several $C_7$ components (such as $nC_6$, $nC_7$, $C_4H_8$) listed in Table 1 have pure-component crystallization temperatures above −95° C., but these components have crystallization points close enough to −95° C. to enable them to remain liquefied in the presence of lower molecular weight components of a typical PLNG composition.

TABLE 1

Pure-Component Freezing Point Temperatures

| | | T (° F.) | T (° C.) | |
|---|---|---|---|---|
| ALKANES | | | | |
| | $C_1$ | −297 | −182.47 | |
| | $C_2$ | −297 | −182.80 | |
| | $C_3$ | −306 | −187.68 | |
| | $nC_4$ | −217 | −138.36 | |
| | $iC_4$ | −256 | −159.60 | |
| | $nC_5$ | −202 | −129.73 | |
| | $iC_5$ | −256 | −159.90 | |
| | neo_$C_5$ | 2 | −16.55 | |
| | $nC_6$ | −140 | −95.32 | |
| | $iC_6$ | −245 | −153.66 | |
| | $nC_7$ | −131 | −90.58 | |
| | $iC_7$ | −181 | −118.27 | |
| | $iC_8$ | −165 | −109.04 | |
| | $nC_8$ | −71 | −56.76 | |
| | $nC_9$ | −65 | −53.49 | |
| | $iC_9$ | −113 | −80.40 | |
| | $nC_{10}$ | −22 | −29.64 | |
| | $iC_{10}$ | −103 | −74.65 | |
| | $nC_{11}$ | −14 | −25.58 | |
| | $iC_{11}$ | −56 | −48.86 | |
| | $nC_{12}$ | 14 | −9.58 | |
| | $iC_{12}$ | −53 | −46.81 | |
| | $nC_{13}$ | 22 | −5.39 | |
| | $iC_{13}$ | −15 | −26.00 | |
| | $nC_{14}$ | 42 | 5.86 | |
| | $iC_{14}$ | −13 | −25.00 | |
| | $nC_{15}$ | 50 | 9.92 | |
| | $iC_{15}$ | 17 | −8.30 | |
| | $nC_{16}$ | 64 | 18.16 | |
| | $iC_{16}$ | 19 | −7.00 | |
| | $nC_{17}$ | 71 | 21.98 | |
| | $iC_{17}$ | 39 | 4.00 | |
| | $nC_{18}$ | 82 | 28.16 | |
| | $iC_{18}$ | 42 | 6.00 | |
| | $nC_{19}$ | 89 | 31.89 | |
| | $iC_{19}$ | 59 | 15.00 | |
| | $nC_{20}$ | 97 | 36.43 | |
| | $iC_{20}$ | 65 | 18.30 | |
| CYCLO-ALKANES | | | | |
| | $C_4H_8$ | −132 | −90.73 | cyclobutane |
| | $C_5H_{10}$ | −137 | −93.88 | cyclopentane |
| | $C_6H_{12}$ | 43 | 6.55 | cyclohexane |
| | $C_7H_{14}$ | 17 | −8.00 | cycloheptane |
| | $C_8h_{16}$ | 58 | 14.80 | cyclooctane |
| | $C_9H_{18}$ | 51 | 11.00 | cyclononane |
| | $C_{10}H_{20}$ | 51 | 11.00 | cyclodecane |
| | $C_6H_{12}$ | −224 | −142.2 | methl-cylopentane |
| | $C_7h_{14}$ | −196 | −126.6 | methyl-cyclohexane |
| ALKYL-BENZENES | | | | |
| benzene | $C_6H_6$ | 42 | 5.53 | |
| methyl_b | $C_7H_8$ | −139 | −94.94 | |
| ethyl_b | $C_8H_{10}$ | −139 | −94.96 | |
| propyl_b | $C_9H_{12}$ | −147 | −99.50 | |
| butyl_b | $C_{10}H_{14}$ | −127 | −87.96 | |
| Toluene | $C_7H_8$ | −139 | −94.94 | |
| o-Xylene | $C_8H_{10}$ | −13 | −25 | |
| m-Xylene | $C_8H_{10}$ | −54 | −47.77 | |
| p-Xylene | $C{=}H_{10}$ | 56 | 13.3 | |
| OTHER COMPONENT(S) | | | | |
| carbon_dioxide | CO2 | −70 | −56.55 | |

The actual freezing point temperature in a hydrocarbon mixture would be lower than the normal freezing point of the pure components, and the actual freezing point temperature of a component in a mixture of components can be determined by commercially available software that calculates the equation of state of a multi-component mixture and/or the freezing points. Such freezing point determinations can also be made experimentally by well-known procedures. Therefore, depending on the composition of the PLNG, a particular component having a freezing point above the PLNG temperature may nevertheless not solidify in a particular mixture of PLNG because the other components may depress its freezing point. In the past, the potential difficulties of solidification were avoided by removing, early in the gas handling process, those contaminants having a pure-component freezing temperature above the temperatures anticipated in the future processing and transportation of the gas. In this invention, it is possible to retain heavy hydrocarbon components in the PLNG that in the past would have been removed before the gas liquefaction process. The basic steps of the invention will now be described with reference to the drawings.

FIG. 1 is a diagrammatic representation of one embodiment of the invention in which a natural gas feed stream A (preferably rich in methane and typically containing $C_{2+}$ hydrocarbons in varying concentrations) passes through one or more stages of a gas separation system 11. Natural gas feed stream A (stream 10) preferably enters the system at a pressure above about 3,100 kPa (450 psia) and more preferably above about 4,800 kPa (700 psia) and a temperature preferably between about 0° C. and 40° C.; however, different pressures and temperatures can be used, if desired, and the system can be modified accordingly. If the gas stream A is below about 1,380 kPa (200 psia), the gas stream may be pressurized by any suitable compression means (not shown), which may comprise one or more compressors. Separation system 11 suitably treats gas stream 10 to remove water (stream 30) using conventional, well-known processes to produce a "dry" natural gas stream. Conditioning system 11 also removes crude oil, condensates, and any solids (stream 31) that may be in gas stream A. Natural gas treated by separation system 11 is passed to one or more stages of a selective extraction system 12 to selectively remove natural gas components that could be expected to freeze at a predetermined temperature for later storage or transportation of PLNG. The selective extraction system 12 can comprise any suitable system for selectively removing freezable (crystallizable) components. The selective extraction system 12 may for example be a fractionation system that removes unwanted hydrocarbon components from the natural gas. The fractionation system may comprise one or more fractionation columns (not shown) in which a liquid stream 22 enriched in one or more of the freezable components is removed from the natural gas. The general operation of a fractionation system is known to those skilled in the art. A preferred selective extraction system 12 comprises one or more stages of cooling the natural gas to a thermodynamic condition to selectively solidify and remove components of the natural gas. As a non-limiting example, the selective extraction system 12 may comprise a throttling step in which natural gas of stream 21 is throttled from one pressure and temperature in which the natural gas is entirely in a vapor phase and/or liquid phase to a lower pressure and lower temperature at which one or more components of the natural gas stream freeze out to yield a slurry of solid components. Most of the components that crystallize out will be $C_{5+}$ hydrocarbon components, but at least one $C_{5+}$ hydrocarbon component would remain substantially un-crystallized. At least a portion of the remaining vapor and/or liquid (stream 23) is then passed to a liquefaction system 14 for liquefaction. The slurry of solids and liquid natural gas may be separated by gravity, filtration, inertia type segregation equipment, or any other suitable separation means and removed from the selective extraction system 12 as stream 22.

Liquefaction system 14 may comprise any suitable cooling system for liquefying at least part of the conditioned natural gas. Non-limiting examples of a suitable liquefaction system 14 may comprise (1) one or more stages of cascade or multi-component closed-loop refrigeration systems that cools the natural gas in one or more heat exchange stages, (2) an open-loop refrigeration system using single or multi-stage pressure cycles to pressurize the natural gas stream followed by single or multi-stage expansion cycles to reduce the pressure of the compressed stream and thereby reduce its temperature, or (3) indirect heat exchange relationship with a product stream to extract from the product stream the refrigeration contained therein, or (4) a combination of these cooling systems. The optimal liquefaction system can be determined by those skilled in the art taking into account the flow rate of the natural gas to be liquefied and its composition. From the liquefaction system 14, the liquefied product is passed as stream 24 to a suitable storage or transportation means (not shown) such as a stationary storage tank or carrier such as a ship, truck, railcar, barge or any other means for transporting PLNG.

The feed gas A (stream 10) may be crude and/or condensate produced from a hydrocarbon-bearing formation. Gas found together with crude oil is known as "associated gas," whereas gas found separate from crude oil is known as "non-associated gas." Associated gas may be found as "solution gas" dissolved within crude oil and/or as "gas cap gas" adjacent to the main layer of crude oil. Associated gas is usually much richer in the larger hydrocarbon molecules ($C_{5+}$) than non-associated gas.

If a feed gas does not require treatment by a separation system 11, such as a previously processed stream of associated gas, the gas may be introduced directly to the selective extraction system as illustrated in FIG. 1 by feed gas B. Non-associated gas from pressurized storage vessels, from flue gas, from landfill gas, or from any other available source that does not contain freezable components and may be added to the process at any point in the treatment process before liquefaction system 14, which is represented in FIG. 1 as feed gas C. For a methane-rich multi-component stream 20 being liquefied by the process of FIG. 1 to a desired product temperature, it may be desirable to lower the bubble point pressure of the liquid product 24 than would be possible without the addition of other components. The bubble point pressure of product stream 24 can be reduced by admixing to the feed gas A, at any point in the process, $C_{2+}$ hydrocarbons. For example, feed gas B or feed gas C could comprise ethane, propane, and butane, either alone or in combination.

Figure 2:
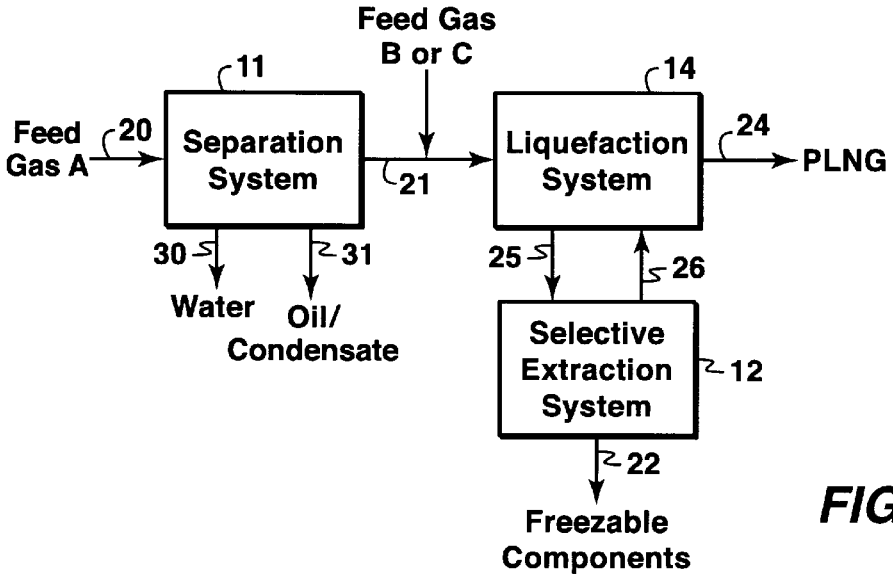
FIG. 2 is a diagrammatic representation of an alternative process of the invention.

FIG. 2 is a diagrammatic representation of another embodiment of the invention, similar to the process represented in FIG. 1, except that during the liquefaction of the natural gas at least part of the liquefied natural gas is sent to the selective extraction system 12 for removal of freezable components at a selected temperature and pressure. Referring to FIG. 2, after the feed gas has been conditioned by separation system 11, natural gas is passed to a liquefaction system 14. At least a portion of the liquefied natural gas is passed as stream 25 to the selective extraction system 12 in which components in the liquid freeze out at a selected temperature and pressure. A slurry rich in the freezable component may be removed from the extraction system 12 as stream 22 and vapor and/or liquid depleted of the freezable components is returned to the liquefaction system 14.

Figure 3:
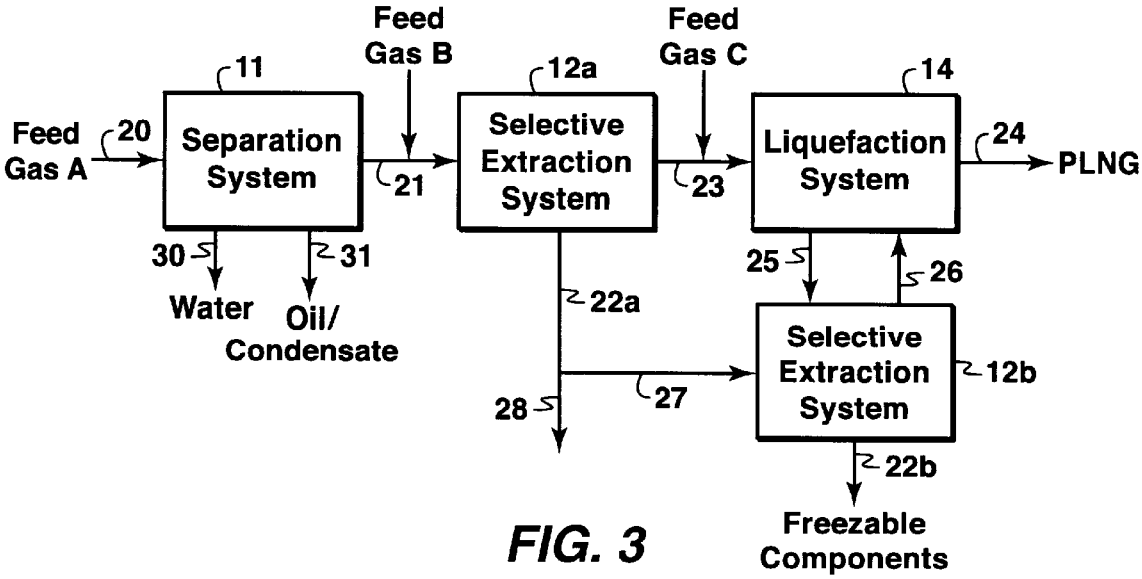
FIG. 3 is a diagrammatic representation of another process of the invention that shows a combination of the hydrocarbon selective removal features of FIGS. 1 and 2.

FIG. 3 is a diagrammatic representation of still another embodiment of the invention which comprises two selective extraction systems 12*a* and 12*b* and which operationally combines the processes illustrated in FIGS. 1 and 2. The selective extraction system 12*a* produces at least two streams: one stream comprises vaporous natural gas stream 23 and a second stream comprises a solids-containing liquid slurry 22*a* enriched in freezable components at a selected temperature and pressure. At least part of the slurry 22*a* is passed as stream 27 to the second selective extraction system 12*b* and a remaining portion of stream 22*a* may be withdrawn as stream 28 for further processing.

Figure 4:
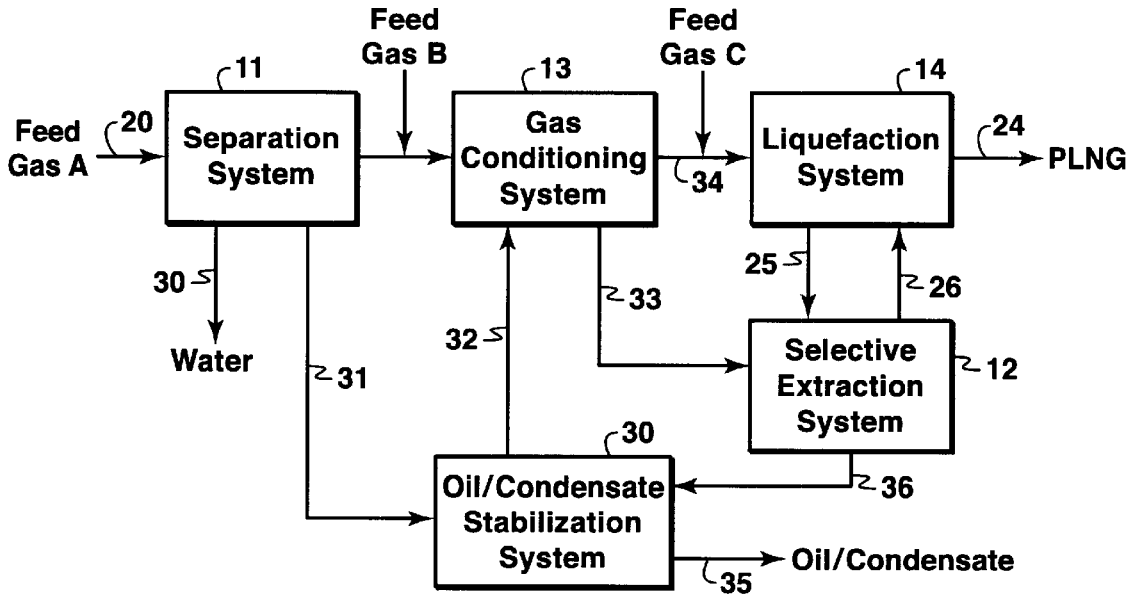
FIG. 4 is a diagrammatic representation of still another process of the invention showing use of a oil/condensate stabilization system in the process.

FIG. 4 is a diagrammatic representation of still another embodiment of the invention that is similar to the process depicted in FIG. 2 except that a gas conditioning system 13 and an oil/condensate stabilization system 30 are shown as part of the process. Condensate and crude oil from conditioning system 11 are passed as stream 31 to the oil and condensate stabilization system 30 which produces a stable liquid product, represented by stream 35, that has a vapor pressure close to or below any pressure condition that is likely to be encountered during subsequent storage, transport or use, taking into account also temperature variations that may occur. The stabilization system 30 may comprise one or more conventional stabilization stages that reduce the light hydrocarbon content of the liquid stream 31. The stabilization system 30 produces at least two streams: a stream 32 containing gaseous components which is shown in FIG. 4 as being passed to the gas conditioning system 13 and a stabilized condensate stream 35. Liquid from selective extraction system 12 is preferably passed as stream 36 to the stabilization system 30 where the solids can be melted by the heat of liquid of stream 31 and processed in the stabilization system 30. The gas conditioning system 13 primarily serves to dehydrate the gas stream and remove any liquids formed prior to liquefaction. Liquid hydrocarbons removed from the in gas conditioning system 13 is preferably passed from conditioning system 13 as stream 33 to selective extraction system 12.

Figure 5:
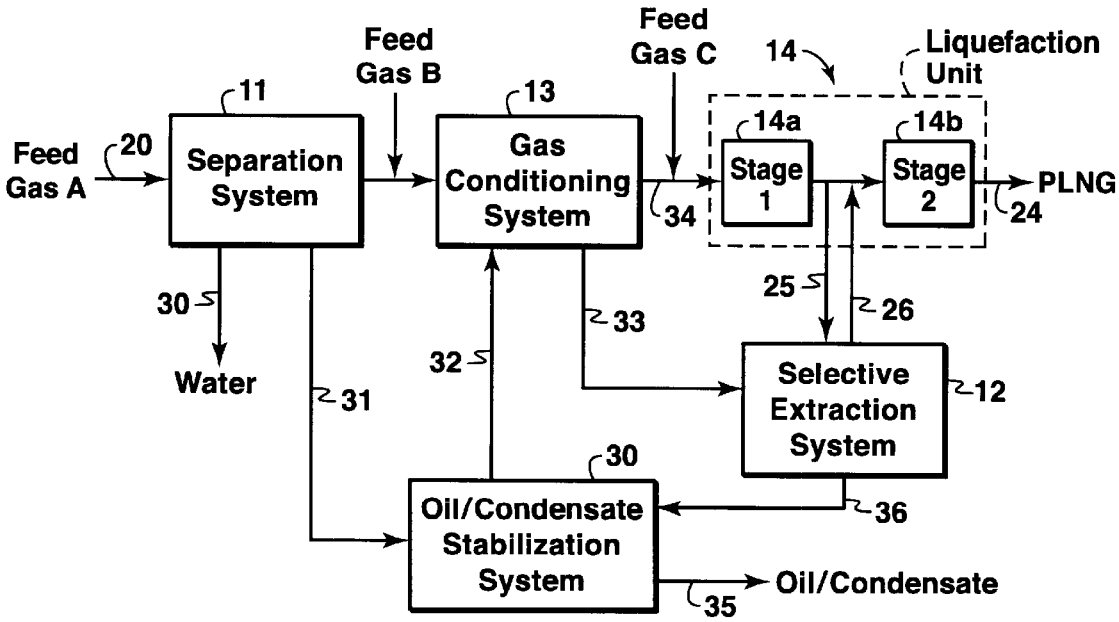
FIG. 5 is a diagrammatic representation of still another process of the invention that shows up to three separate feed streams having different compositions being introduced to the process.

FIG. 5 is a diagrammatic representation of still another embodiment of the invention, similar to the embodiment of FIG. 4, except that liquefaction system 12 is illustrated as having two stages 14*a* and 14*b*. At least a portion of the liquid of the multi-phase product of liquefaction stage 14*a* is passed as steam 25 to the selective extraction system 12. From the selective extraction system 12, liquid, lean in solids that have been selectively removed from liquid stream 25, is returned as stream 26 to a second stage 14*b* of the liquefaction system 14 for further cooling. The liquid first produced by liquefaction stage 14*a* is richer in the more readily freezable constituents than liquid produced in liquefaction stage 14*b*, thereby facilitating reduction of the freezable components in the stream to be liquefied. Selection of a suitable temperature and pressure for operation of the selective extraction system 12 is influenced by the composition of feed streams A, B, and C, the desired degree of product purity (stream 24), and other economic considerations well known to those skilled taking into account the teachings of this description. The operating temperature of selective extraction system 12 will be cooler than the liquefaction temperature of liquefaction system 14*a*. The temperature and pressure to obtain solidification of the component to be selectively removed can be determined using conventional equation of state models or by experimentation using testing procedures well known to those skilled in the art.

Figure 6:
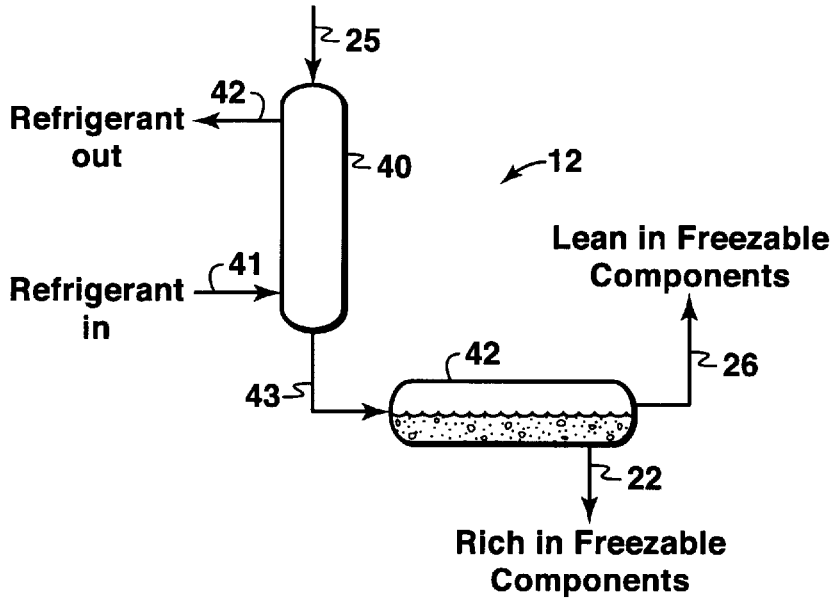
FIG. 6 is a schematic representation of a selective extraction system that extracts by crystallization, selected hydrocarbon components that may freeze in pressured liquid natural gas at a predetermined temperature and pressure.

FIG. 6 is a schematic representation of a selective extraction system 12 that may be used to selectively solidify natural gas components that would be expected to freeze in pressurized liquid natural gas at a selected storage and transportation temperature and pressure. The flow streams 25 and 26 to and from selective extraction system 12 correspond to the flow streams 25 and 26 as described in this description with reference to the embodiment shown in FIG. 2. As shown in FIG. 6, liquid stream 25 is passed to a refrigeration column 40 that is cooled to a selected temperature by refrigerant entering the column 40 through inlet 41 and refrigerant exiting the column through outlet 42. The temperature and pressure in column 40 are controlled to freeze out those components that would freeze under selected PLNG storage and transportation conditions. A solids slurry is continuously withdrawn from the lower part of refrigeration column 40 and passed through line 43 to any suitable solids-liquid separator. Many types of separators are possible; the simplest is a gravitational separator tank 44, as depicted in FIG. 6, which has a long residence time for the fluid, during which separation occurs. In the settling tank 44, solid particles settle out or concentrate in the lower part of the settling tank. Solids-enriched liquid is withdrawn as stream 22 from the bottom of tank 44 and a liquid lean in solids is withdrawn as stream 26 from the top of the tank.

Figure 7:
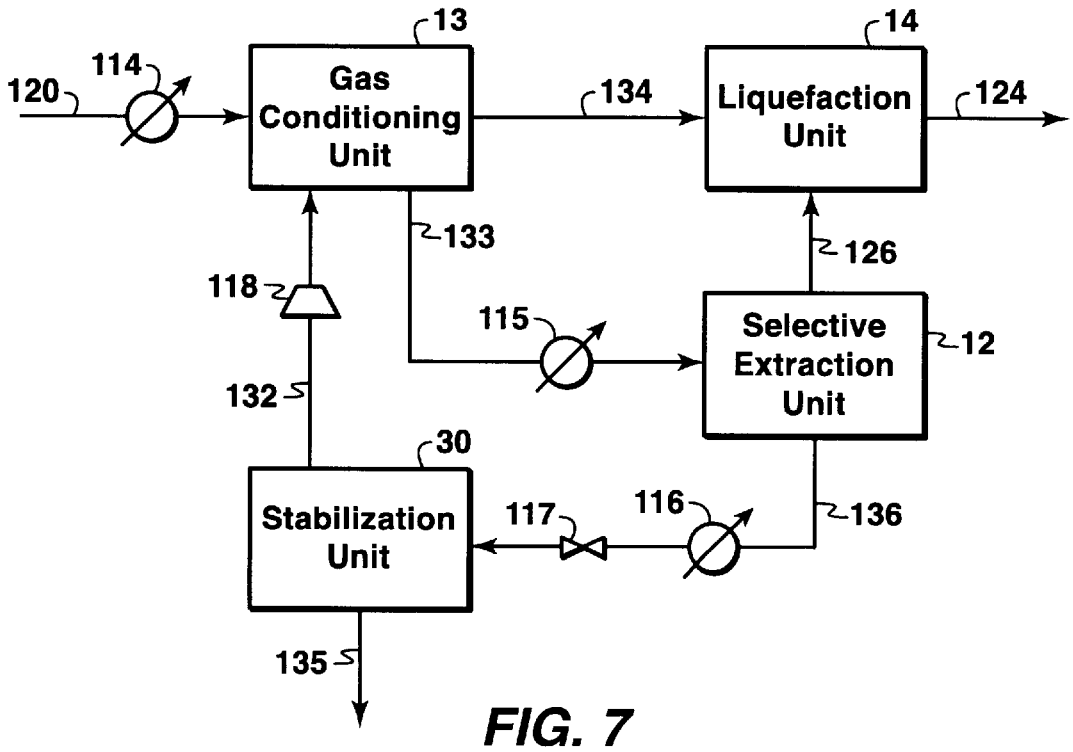
FIG. 7 is schematic representation of still another embodiment of the invention, which is used as the basis for the example simulation described in the description.

FIG. 7 diagrammatically illustrates still another embodiment of the invention. In this embodiment, a natural gas stream produced by a conventional gas well is passed as stream 120 to a conventional cooler 114 and then to gas conditioning system 13. Although not shown in FIG. 7, the gas stream 120 will typically be treated by a separation system to remove any water, oil, hydrocarbon condensate, and other contaminates. A liquid stream 133 produced by the gas conditioning system 13 is passed to a conventional cooler 115 and then passed to selective extraction system 12. Vapor from gas conditioning system 13 is passed as stream 134 to liquefaction system 14. Selective extraction system 12 selectively removes components that would solidify at the temperature-pressure conditions of product stream 124 produced by the liquefaction system 14. A slurry enriched in crystallized components is removed the selective extraction system as stream 136 is heated by heater 116 by any suitable heating means and then passed through a pressure expansion means such as a Joule-Thomson valve 117. The depressurized stream 137 is then passed to an oil/condensate stabilization system 30. The stabilization system 30 produces a liquid product stream 135 and a vapor stream 132. Vapor stream 132 is pressurized by compressor 118 to approximately the same pressure as the operating pressure of gas conditioning system 13. Pressurized vapor stream 132 is passed to gas conditioning system 13. Gas lean in components that could solidify at the temperature-pressure conditions of stream 124 is passed to the liquefaction system 14 for further cooling. Liquefaction system 14 produces PLNG as stream 124 that may then be stored in suitable containers and/or transported.

Simulation

A hypothetical mass and energy balance was carried out to illustrate the embodiment shown in the FIG. 7. The data were obtained using a commercially available process simulation program called HYSYS™, version 1.5.2, (available from Hyprotech Ltd. of Calgary, Canada) and a proprietary thermodynamic property simulator.

The results of the simulation are shown in Tables 2 and 3. This data assumed the feed gas stream had the composition shown in first column of Table 2. The data presented in Table 2 are offered to provide a better understanding of the embodiment shown in the FIG. 7, but the invention is not to be construed as unnecessarily limited thereto. The temperatures, pressures, compositions, and flow rates can have many variations in view of the teachings in this description.

The simulation results illustrate possible thermodynamic state points for a process path that demonstrate the invention. The full wellstream ("FWS") composition includes significant quantities of heavy hydrocarbons that would otherwise freeze-out in a conventional LNG simulation. In the gas conditioning system, 29% of the feed stream is separated as liquid rich in the freezable components which is sent to the selective extraction system. A small fraction (18%) of this stream is extracted as a slurry in the selective extraction system 12 which contains a high concentration of the heavy freezable components and the remaining 82% of the stream is blended back for liquefaction. Thus the effective shrinkage due to the extraction process is 4% and 96% of the feed stream is liquefied. This compares with 16% shrinkage associated with the LNG composition indicated in Table 3.

TABLE 2

| | Stream compositions (mole fractions) | | | | | | | |
|---|---|---|---|---|---|---|---|---|
| HYSYS - 60 (FWS) | FWS | Vapor to Liquefier | Liquid Before Extraction | Liquid Blendback | Slurry Extracted | Vapor Recycle | Liquid Recycle C & C | Liquid Product PLNG |
| Temperature (° F.) | 90 | 66.9 | 66.9 | −140 | −140 | 110.4 | 110.4 | −138.9 |
| (° C.) | 32.2 | 19.4 | 19.4 | 95.6 | −95.6 | 43.6 | 43.6 | −94.9 |
| Pressure (psia) | 810 | 800 | 800 | 450 | 450 | 16 | 16 | 380 |
| (kPa) | 5585 | 5516 | 5516 | 3103 | 3103 | 110 | 110 | 2620 |
| FIG. 7 Stream # | 120 | 134 | 133 | 126 | 136 | 132 | 135 | 124 |
| Methane | 0.6882 | 0.8820 | 0.2147 | 0.2343 | 0.1251 | 0.4911 | 0.0023 | 0.7170 |
| Ethane | 0.0653 | 0.0648 | 0.0703 | 0.0768 | 0.0404 | 0.1521 | 0.0036 | 0.0679 |
| Propane | 0.0393 | 0.0249 | 0.0786 | 0.0860 | 0.0448 | 0.1467 | 0.0115 | 0.0405 |
| i-Butane | 0.0085 | 0.0032 | 0.0223 | 0.0244 | 0.0125 | 0.0325 | 0.0062 | 0.0086 |
| n-Butane | 0.0166 | 0.0048 | 0.0456 | 0.0501 | 0.0254 | 0.0583 | 0.0153 | 0.0164 |
| i-Pentane | 0.0087 | 0.0014 | 0.0268 | 0.0294 | 0.0148 | 0.0210 | 0.0132 | 0.0085 |
| n-Pentane | 0.0092 | 0.0011 | 0.0290 | 0.0318 | 0.060 | 0.0189 | 0.0155 | 0.0089 |
| Hexanes | 0.0156 | 0.0009 | 0.0511 | 0.0561 | 0.0282 | 0.0164 | 0.0327 | 0.0150 |
| Me-Cyclo-Pentane | 0.0074 | 0.0003 | 0.0243 | 0.0266 | 0.0135 | 0.0060 | 0.0161 | 0.0070 |
| Benzene | 0.0040 | 0.0001 | 0.0132 | 0.0145 | 0.0073 | 0.0031 | 0.0088 | 0.0038 |
| Cyclo-Hexane | 0.0074 | 0.0003 | 0.0244 | 0.0267 | 0.0135 | 0.0049 | 0.0165 | 0.0070 |
| Heptanes | 0.0163 | 0.0004 | 0.0541 | 0.0594 | 0.0301 | 0.0068 | 0.0380 | 0.0154 |
| Me-Cyclo-Hexane | 0.0129 | 0.0003 | 0.0430 | 0.0472 | 0.0240 | 0.0044 | 0.0305 | 0.0122 |
| Toluene | 0.0085 | 0.0001 | 0.0285 | 0.0313 | 0.0159 | 0.0023 | 0.0204 | 0.0080 |

TABLE 2-continued

| HYSYS - 60 (FWS) | FWS | Vapor to Liquefier | Liquid Before Extraction | Liquid Blendback | Slurry Extracted | Vapor Recycle | Liquid Recycle C & C | Liquid Product PLNG |
|---|---|---|---|---|---|---|---|---|
| | Stream compositions (mole fractions) | | | | | | | |
| Octanes | 0.0202 | 0.0002 | 0.0676 | 0.0637 | 0.0856 | 0.0078 | 0.1104 | 0.0164 |
| Ethyl-Benzene | 0.0025 | 0.0000 | 0.0082 | 0.0090 | 0.0046 | 0.0002 | 0.0060 | 0.0023 |
| Meta-Para-Xylene | 0.0066 | 0.0000 | 0.0221 | 0.0242 | 0.0123 | 0.0005 | 0.0162 | 0.0062 |
| Ortho-Xylene | 0.0031 | 0.0000 | 0.0104 | 0.0114 | 0.0058 | 0.0002 | 0.0076 | 0.0029 |
| Nonanes | 0.0195 | 0.0001 | 0.0655 | 0.0718 | 0.0365 | 0.0013 | 0.0481 | 0.0183 |
| Tri-Me-Benzene | 0.0031 | 0.0000 | 0.0104 | 0.0114 | 0.0058 | 0.0001 | 0.0077 | 0.0029 |
| Decanes+ | 0.0241 | 0.0000 | 0.0809 | 0.0042 | 0.4326 | 0.0054 | 0.5731 | 0.0011 |
| Carbon Dioxide | 0.0127 | 0.0144 | 0.0089 | 0.0097 | 0.0052 | 0.0199 | 0.0002 | 0.0132 |
| Nitrogen | 0.0004 | 0.0005 | 0.0000 | 0.0000 | 0.0000 | 0.0001 | 0.0000 | 0.0004 |
| | 1.0000 | 1.0000 | 1.0000 | 1.0000 | 1.0000 | 1.0000 | 1.0000 | 1.0000 |

TABLE 3

| | FWS | LNG Liquid/Solid Boundary | | Threshold PLNG Liquid/Solid Boundary | | HYSYS Simulation Results for PLNG |
|---|---|---|---|---|---|---|
| | Component compostions (mole fractions) | | | | | |
| | Liquid | Liquid | Solid | Liquid | Solid | Liquid |
| Methane | 0.6882 | 0.8136 | 0.0000 | 0.7064 | 0.0000 | 0.7170 |
| Ethane | 0.0653 | 0.0772 | 0.0000 | 0.0670 | 0.0000 | 0.0679 |
| Propane | 0.0393 | 0.0465 | 0.0000 | 0.0404 | 0.0000 | 0.0405 |
| i-Butane | 0.0085 | 0.0101 | 0.0000 | 0.0088 | 0.0000 | 0.0086 |
| n-Butane | 0.0166 | 0.0196 | 0.0000 | 0.0170 | 0.0000 | 0.0164 |
| i-Pentane | 0.0087 | 0.0102 | 0.0000 | 0.0089 | 0.0000 | 0.0085 |
| n-Pentane | 0.0092 | 0.0100 | 0.0049 | 0.0094 | 0.0000 | 0.0089 |
| Hexanes | 0.0156 | 0.0003 | 0.1001 | 0.0161 | 0.0000 | 0.0150 |
| Me-Cyclo-Pentane | 0.0074 | 0.0066 | 0.0117 | 0.0076 | 0.0000 | 0.0070 |
| Benzene | 0.0040 | 0.0000 | 0.0260 | 0.0041 | 0.0000 | 0.0038 |
| Cyclo-Hexane | 0.0074 | 0.0004 | 0.0456 | 0.0076 | 0.0000 | 0.0070 |
| Heptanes | 0.0163 | 0.0000 | 0.1054 | 0.0167 | 0.0000 | 0.0154 |
| Me-Cyclo-Hexane | 0.0129 | 0.0006 | 0.0806 | 0.0133 | 0.0000 | 0.0122 |
| Toluene | 0.0085 | 0.0004 | 0.0534 | 0.0088 | 0.0000 | 0.0080 |
| Octanes | 0.0202 | 0.0000 | 0.1368 | 0.0183 | 0.0908 | 0.0164 |
| Ethyl-Benzene | 0.0025 | 0.0002 | 0.0146 | 0.0025 | 0.0000 | 0.0023 |
| Meta-Para-Xylene | 0.0066 | 0.0000 | 0.0428 | 0.0061 | 0.0245 | 0.0062 |
| Ortho-Xylene | 0.0031 | 0.0000 | 0.0201 | 0.0032 | 0.0000 | 0.0029 |
| Nonanes | 0.0195 | 0.0000 | 0.1265 | 0.0200 | 0.0000 | 0.0183 |
| Tri-Me-Benzene | 0.0031 | 0.0037 | 0.0000 | 0.0032 | 0.0000 | 0.0029 |
| Decanes+ | 0.0241 | 0.0000 | 0.1560 | 0.0012 | 0.8847 | 0.0011 |
| Carbon Dioxide | 0.0127 | 0.0001 | 0.0816 | 0.0130 | 0.0000 | 0.0132 |
| Nitrogen | 0.0004 | 0.0005 | 0.0000 | 0.0004 | 0.0000 | 0.0004 |
| | 1.0000 | 1.0000 | 1.0000 | 1.0000 | 1.0000 | 1.0000 |

The benefits of the invention can also be seen from data presented in Table 3. Using a proprietary thermodynamic property simulator and the same feed composition used to obtain the data of Table 1, the phase state for each component was determined for the pressure and temperature conditions of LNG ("LNG conditions") and the pressure and temperature conditions of a PLNG ("PLNG conditions"). The LNG conditions were assumed to be −160° C. and atmospheric pressure and the PLNG conditions were assumed to be −95° C. and 380 psia. At the LNG conditions, 14 hydrocarbon components and $CO_2$ were calculated as crystallizing out, whereas at PLNG conditions only three components were calculated as crystallizing out (octanes, meta-para-xylene, and decanes+). Therefore, in treating this particular gas composition for storage and/or transportation at the PLNG conditions, the process should at least selectively remove from the natural gas stream octanes, meta-para-xylene, and decanes+ to reduce the concentration of these three components to a level such that crystallizing out of these components at the selected storage and/or transportation would not occur. The actual PLNG composition resulting from the practice of this invention using HYSYSTM represented by FIG. 7, is shown in Table 3 as "HYSYS Simulation Results for PLNG". The process of FIG. 7 removes more than the required minimum amount of the three components (octanes, meta-para-xylene, and decanes+) to prevent crystallization in the PLNG product.

A person skilled in the art, particularly one having the benefit of the teachings of this patent, will recognize many modifications and variations to the specific embodiment disclosed above. For example, a variety of temperatures and pressures may be used in accordance with the invention, depending on the overall design of the system, the desired component recoveries and the composition of the PLNG. Additionally, certain process steps may be accomplished by adding devices that are interchangeable with the devices shown. As discussed above, the specifically disclosed embodiment and example should not be used to limit or restrict the scope of the invention, which is to be determined by the claims below and their equivalents.

We claim:

1. A process of manufacturing a pressurized multi-component liquid, comprising:

(a) providing a pressurized, multi-component stream comprising $C_{6+}$ components and at least one component of $C_1$, $C_2$, $C_3$, $C_4$, or $C_5$;

(b) removing from the multi-component stream one or more of the $C_{6+}$ components and leaving in the multi-component stream at least one $C_{6+}$ component; and (c) liquefying the multi-component stream to produce a pressurized liquid substantially free of crystallized $C_{6+}$ components.

2. The process of claim 1 wherein the removal of the one or more $C_{6+}$ components from the multi-component stream comprises fractionating the multi-component stream to produce a first stream lean in crystallizable $C_{6+}$ components and a second stream enriched in crystallizable $C_{6+}$ components, said first stream being liquefied to produce a pressurized liquid substantially free of crystallized $C_{6+}$ components.

3. The process of claim 1 wherein the removal of the one or more $C_{6+}$ components from the multi-component gas stream comprises crystallizing the one or more $C_{6+}$ components, leaving at least one $C_{6+}$ component un-crystallized, and separating the crystallized components from the multi-component stream.

4. The process of claim 3 wherein the crystallized components comprises hydrocarbons of $C_{7+}$.

5. The process of claim 3 wherein the at least one un-crystallized $C_{6+}$ component comprises at least one of $nC_6$, $iC_6$, $nC_7$, or $iC_7$.

6. The process of claim 3 wherein the process further comprises removing from the pressurized multi-component stream at least one of water or hydrocarbon condensate.

7. The process of claim 1 wherein the multi-component stream comprises natural gas produced from a subterranean formation.

8. The process of claim 7 further comprises, prior to liquefaction of the multi-component stream, adding to the multi-component stream a hydrocarbon composition comprising $C_{2+}$ hydrocarbons.

9. The process of claim 4 wherein the multi-component stream further comprises carbon dioxide and the process further comprises removing at least part of the carbon dioxide prior to liquefaction of the multi-component stream.

10. The process of claim 1 wherein the liquefied multi-component stream has a temperature above −112° C. and a pressure sufficient for the stream to be at or below its bubble point.

11. The process of claim 10 wherein the pressurized multi-component stream exceeds 1,400 kPa.

12. The process of claim 10 wherein the pressurized multi-component stream exceeds 2,800 kPa.

13. The process of claim 1 further comprising:

(d) removing from the pressurized multi-component stream at least one of water or hydrocarbon condensate;

(e) the removal from the multi-component stream one or more of the $C_{6+}$ components being at least partially performed in a first selective extraction system, the selective extraction system producing a first stream lean in crystallized $C_{6+}$ components and a second stream enriched in $C_{6+}$ components;

(f) passing at least a portion of the second stream to a second selective extraction system;

(g) liquefying at least a portion of the first stream in a liquefaction system;

(h) passing at least a portion of the liquid stream of step (g) to a second selective extraction system; the second selective extraction system producing a third stream lean in crystallized $C_{6+}$ components and a fourth stream enriched in crystallized $C_{6+}$ components; and (g) passing the third stream to the liquefaction system, the liquefaction system producing a pressurized liquid stream having a temperature above −112° C. and a pressure at or below the bubble point temperature.

14. A method of transporting a hydrocarbon composition rich in at least one of $C_1$ or $C_2$, comprising:

(a) admixing $C_{2+}$ hydrocarbons with the hydrocarbon composition, said mixture containing $C_{6+}$ components;

(b) removing from the mixture one or more of $C_{6+}$ components and leaving in the mixture at least one $C_{6+}$ component; and (c) liquefying the mixture to produce a pressurized liquid at a temperature above −112° C. (−170° F.), said liquid being substantially free of crystallized $C_{6+}$ components; and (d) transporting the liquid at a temperature above −112° C. (−170° F.) and a pressure sufficient for the liquid to be at or below its bubble point temperature.

15. A method of treating a pressurized methane-rich feedstock for transport, comprising the steps of:

(a) adding to the methane-rich feedstock at least one hydrocarbon having a molecular weight heavier than that of $C_5$;

(b) removing from the feedstock one or more hydrocarbon components having a molecular weight heavier than that of $C_5$ leaving in the feedstock at least one component having a molecular weight heavier than $C_5$; and (c) liquefying the feedstock, said liquefied feedstock having a temperature above −112° C. and a pressure sufficient for the liquid to be at or below its bubble point temperature, the liquid feedstock being substantially free of crystallized hydrocarbons.

16. A process of manufacturing a pressurized multi-component liquid, comprising:

(a) providing a multi-component fluid stream comprising one or more $C_{6+}$ components and at least one component comprising at least one of $C_1$, $C_2$, $C_3$, $C_4$, or $C_5$;

(b) crystallizing one or more of the $C_{6+}$ components and leaving substantially un-crystallized one or more $C_{6+}$ components;

(c) separating the multi-component stream into a first stream lean in the crystallizable $C_{6+}$ components and a second stream enriched in the crystallizable $C_{6+}$ components; and (d) liquefying the first stream to a selected temperature and pressure.

17. A process for manufacturing a liquefied natural gas stream, comprising:

(a) providing a natural gas stream at a pressure above at least 1,400 kPa;

(b) removing from the natural gas stream at least one of water or hydrocarbon condensate;

(c) selectively removing from the gas stream at least one $C_{6+}$ component that would crystallize at a pre-selected temperature and pressure, said pre-selected temperature being above −112° C. and the pressure being approximately the pressure of the anticipated pressurized liquid product; and (d) liquefying the gas stream to produce a pressurized liquid product having a temperature above −112° C. and a pressure at or below the bubble point temperature.

18. The process for manufacturing a liquefied natural gas stream, comprising:

(a) providing a natural gas stream at a pressure above at least 1,400 kPa;

(b) removing from the natural stream at least one of water, oil, or hydrocarbon condensate;

(c) selectively removing from the gas stream $C_{5+}$ components that would freeze at a pre-selected temperature and pressure;

(d) liquefying at least a portion of the gas stream;

(e) passing at least a portion of the liquefied stream to a selective extraction system, the extraction system producing a first stream lean crystallized $C_{5+}$ components and a second stream enriched in $C_{5+}$ components; and (f) passing the first stream lean in crystallized $C_{5+}$ components to the liquefaction system for liquefaction to produce a pressurized liquid stream having a temperature above −112° C. and a pressure at or below the bubble point temperature.

19. The process for manufacturing a liquefied natural gas stream, comprising:

(a) providing a natural gas stream at a pressure above at least 1,400 kPa;

(b) removing from the natural stream at least one of water, oil, or hydrocarbon condensate;

(c) passing the natural gas stream to a first selective extraction system, the selective extraction system producing a first stream lean in crystallized $C_{5+}$ components and a second stream enriched in $C_{5+}$ components;

(d) passing at least a portion of the second stream to a second selective extraction system;

(e) passing at least a portion of the first stream to liquefaction system;

(f) withdrawing from the liquefaction system a first liquid stream and passing the first liquid stream to the second selective extraction system; the second selective extraction system producing a third stream lean in crystallized $C_{5+}$ components and a fourth stream enriched in $C_{5+}$ components; and (g) passing the third stream to the liquefaction system, the liquefaction system producing a pressurized liquid stream having a temperature above −112° C. and a pressure at or below the bubble point temperature.

20. The process for manufacturing a liquefied natural gas stream, comprising:

(a) providing a natural gas stream at a pressure above at least 1,400 kPa;

(b) removing from the natural stream at least one of water, oil, or hydrocarbon condensate;

(c) passing the natural gas stream to a first selective extraction system, the selective extraction system producing a first stream lean in crystallized $C_{5+}$ components and a second stream enriched in $C_{5+}$ components;

(d) passing at least a portion of the second stream to a second selective extraction system;

(e) passing at least a portion of the first stream to liquefaction system;

(f) withdrawing from the liquefaction system a first liquid stream and passing the first liquid stream to the second selective extraction system; the second selective extraction system producing a third stream lean in crystallized $C_{5+}$ components and a fourth stream enriched in $C_{5+}$ components; and (g) passing the third stream to the liquefaction system, the liquefaction system producing a pressurized liquid stream having a temperature above −112° C. and a pressure at or below the bubble point temperature.

21. A process for transporting natural gas, comprising:

(a) providing a pressured natural gas having a pressure above 1,400 kPa., said natural gas comprising $C_1$ as a predominate component and $C_{6+}$ components;

(b) removing from the natural gas one or more of the $C_{6+}$ components and leaving in the natural gas at least one $C_{6+}$ component; and (c) liquefying the multi-component stream to produce a pressurized liquid substantially free of crystallized $C_{6+}$ components; and (d) passing the pressurized liquid to a container and transporting the liquid in the container at a temperature above −112° C.

22. The process of claim 21 wherein the removal of the one or more $C_{6+}$ components from the multi-component stream comprises fractionating the multi-component stream to produce a first stream lean in the one or more $C_{6+}$ components and enriched in at least one other $C_{6+}$ component and a second stream enriched in the one or more $C_{6+}$ components.

23. The process of claim 21 wherein the removal of the one or more $C_{6+}$ components from the multi-component gas stream comprises crystallizing the one or more $C_{6+}$ components, leaving at least one $C_{6+}$ component un-crystallized, and separating the crystallized components from the multi-component stream.

24. A pressurized multi-component liquid, comprising multi-component hydrocarbons comprising at least one $C_{6+}$ component and at least one component of $C_1$ or $C_2$, the liquid having a temperature above −112° C. and a pressure sufficient for the liquid to be at or below its bubble point, and the liquid being substantially free of crystallized $C_{6+}$ components.

* * * * *